US006739467B2

(12) United States Patent
Saito et al.

(10) Patent No.: US 6,739,467 B2
(45) Date of Patent: May 25, 2004

(54) BOTTLE-TYPE PLASTIC CONTAINER

(75) Inventors: Hiromichi Saito, Koto-Ku (JP); Takao Iizuka, Koto-Ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 09/989,463

(22) Filed: Nov. 21, 2001

(65) Prior Publication Data

US 2002/0092821 A1 Jul. 18, 2002

(30) Foreign Application Priority Data

Nov. 27, 2000 (JP) ..... 2000-359502

(51) Int. Cl.[7] ..... B65D 90/02
(52) U.S. Cl. ..... 215/384; 215/379
(58) Field of Search ..... 215/384, 383, 215/379

(56) References Cited

U.S. PATENT DOCUMENTS

D198,404 S * 6/1964 Busch ..... D9/522
3,232,495 A * 2/1966 Schneider ..... 215/384
D209,018 S * 10/1967 Holt ..... D9/543
D214,550 S * 7/1969 Plummer ..... D9/522
D219,954 S * 2/1971 Koenigsberg ..... D9/543
D227,222 S * 6/1973 Plummer ..... D9/543
D277,551 S * 2/1985 Kerr ..... D9/543
D279,167 S * 6/1985 Haney et al. ..... D9/540
4,804,097 A * 2/1989 Alberghini et al. ..... 215/384
5,141,121 A * 8/1992 Brown et al. ..... 215/384
5,199,587 A * 4/1993 Ota et al. ..... 215/384
D409,090 S * 5/1999 Lai et al. ..... D9/543
6,029,837 A * 2/2000 Slat et al. ..... 215/384

FOREIGN PATENT DOCUMENTS

JP Y2 4-33238 8/1992
JP Y2 4-33239 8/1992

* cited by examiner

*Primary Examiner*—Tri M. Mai
(74) *Attorney, Agent, or Firm*—Oliff & Berridge, PLC

(57) ABSTRACT

A bottle-type plastic container includes a body and an opening at one end of the container that allows liquid content to be filled into the container and emptied therefrom. The body has a middle height region with front and rear surface portions, and both sides of the rear surface portion are recessed inwards and juxtaposed to each other defining a grip region therebetween. The rear surface portion of the body has a radius of curvature (R2) that is larger that a radius of curvature (R1) of the front surface portion.

4 Claims, 2 Drawing Sheets

BOTTLE-TYPE PLASTIC CONTAINER

BACKGROUND OF THE INVENTION

1. Field of Invention

The present invention relates a bottle-shaped plastic container that is produced by biaxial orientation blow molding process or the like; in particular, it pertains to a container having a body that is partly recessed inwards to afford a grip region.

2. Description of Related Art

Such a bottle-shaped plastic container is disclosed, for example, in JP-4-33,238Y2 or JP-4-33,239Y2, wherein a substantially cylindrical body in its middle height region has a rear surface portion both sides of which are recessed inwards and juxtaposed to each other, to define a grip region therebetween. Such an arrangement proved to be highly advantageous in that a plastic container with an integral grip region can be produced efficiently and at a low cost, without requiring a separate grip member to be prepared in advance and subsequently connected to the body of the container.

In this type of plastic container, however, there may be instances wherein the body undergoes deformation when the grip region is grasped by hand or the inner pressure of the container increases due to an elevated temperature. An excessive deformation of the plastic container often result in overspill of the liquid content out of the container. Also, deformation of the plastic container at a location other than the grip region may degrade the appearance of the container, particularly when the deformed region is a printed surface or bears a heat shrink label or the like, indicating visual information such as trademark or the like. It is anticipated that such a problem becomes more apparent as a result of recently progressing demand for a reduced resin amount that is necessary for forming the container, or for a reduced material thickness of the container, both resulting in a reduced rigidity of the container.

SUMMARY OF THE INVENTION

It is therefore an object of the present invention to provide an improved bottle-shaped plastic container, which eliminates the above-mentioned problems of the prior art by suppressing the deformation at the ornamental front surface portion of the body portion when the grip region is grasped by hand, or the liquid content within the container is subjected to temperature change.

To this end, according to the present invention, a bottle-shaped plastic container includes a body and an opening at one end of the container that allows liquid content to be filled into the container and emptied therefrom. The body has a middle height region with front and rear surface portions, and both sides of the rear surface portion are recessed inwards and juxtaposed to each other defining a grip region therebetween. The rear surface portion of the body has a radius of curvature that is larger that a radius of curvature that is larger that a radius of curvature of the front surface portion.

With the above-mentioned arrangement of the bottle-shaped plastic container according to the present invention, the rear surface portion of the body having a relatively large radius of curvature is more liable to deform, as compared to the front surface portion, when the grip region is grasped or when the liquid content is subjected to a change in temperature. Thus, it is possible effectively to suppress an excessive deformation of the front surface portion of the body, which often forms an/ornamental portion of the container, thereby preventing the appearance of the container from undesirable degradation.

It is preferred that the radius of curvature of the rear surface portion is at least approximately 1.5 times larger than the radius of curvature of the front surface portion.

The middle height region of the body is formed with a reinforcement that extends at least partly in a circumferential direction of the body. Such an arrangement makes it readily possible to optimize the rigidity and/or strength of the container, while allowing a limited deformation of the grip region when being grasped by hand.

The reinforcement may extend in the circumferential direction of the body with a radius of curvature that is larger than the radius of curvature of the rear surface portion of the body.

The container according to the present invention may have an inner volume within a range of 1,800–4,000 $cm^3$.

The container according to the present invention may be a so-called hot fill type container that is filled with a liquid at a temperature as high as 80–95° C.

BRIEF DESCRIPTION OF THE DRAWINGS

The present invention will be explained below in further detail, with reference to a preferred embodiment shown in the drawings, in which.

DETAILED DESCRIPTION OF THE PREFERRED EMBODIMENT

Figures 1A, 1B, 1C:
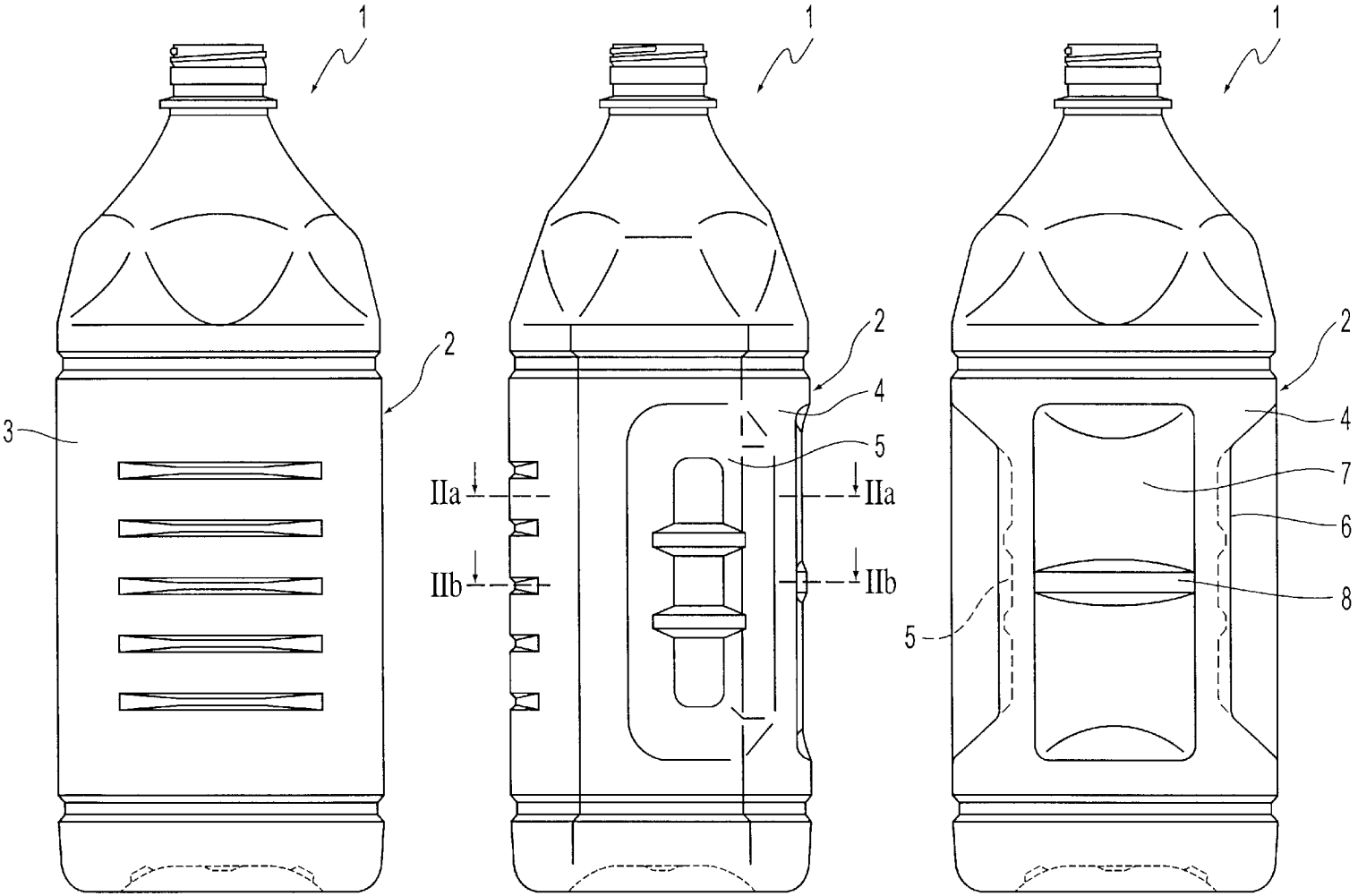
FIGS. 1*a*, 1*b* and 1*c* are side view, front view and rear view, respectively, of the bottle-type plastic container according to one embodiment of the present invention.

Referring now to the drawings, there is shown a bottle-shaped plastic container according to one embodiment of the present invention. The container is designated as a whole by reference numeral 1, and has an opening at an upper end region that allows the container to be filled with liquid contents and emptied therefrom. For the sake of convenience, it is assumed that the container has an inner volume of 2,700 $cm^3$.

The container 1 according to the present invention may be made of an appropriate synthetic resin, typically polyethylene terephthalate (PET) resin. Alternatively, however, the container 1 may be made from polyamid resin, polycarbonate resin, polyacetal resin, polybuthylene terephthalate resin or other synthetic resin having a sufficient resistance to chemicals. The container 1 may be formed by known molding processes, such as biaxial orientation blow molding process or direct blow molding process.

The container 1 includes a body 2 having a middle height region with front and rear surface portions 3, 4, of which the front surface portion 3 serves as an ornamental portion either in the form of a printed surface, or bearing a heat shrink label or the like, indicating visual information such as trademark or the like. On the other hand, as shown in FIG. 1*c*, both sides of the rear surface portion 4 of the body 2 are recessed inwards to provide a pair of depressions 5, 6 that are juxtaposed to each other, defining a grip region therebetween, along with a panel-like region 7. At the middle of the panel-like region 7 is provided with a reinforcing rib 8 that extends in the circumferential direction of the body 2. The reinforcing rib 8 preserves the required rigidity and strength of the container 1, while allowing a limited deformation of the grip region when being grasped by hand, or when the liquid content within the container is subjected to change in temperature. The front surface portion 3 and/or the depressions 5, 6 may also be formed with reinforcements in the form of ribs or grooves, whenever necessary to provide further enhanced rigidity or strength of the container.

Figure 2B:
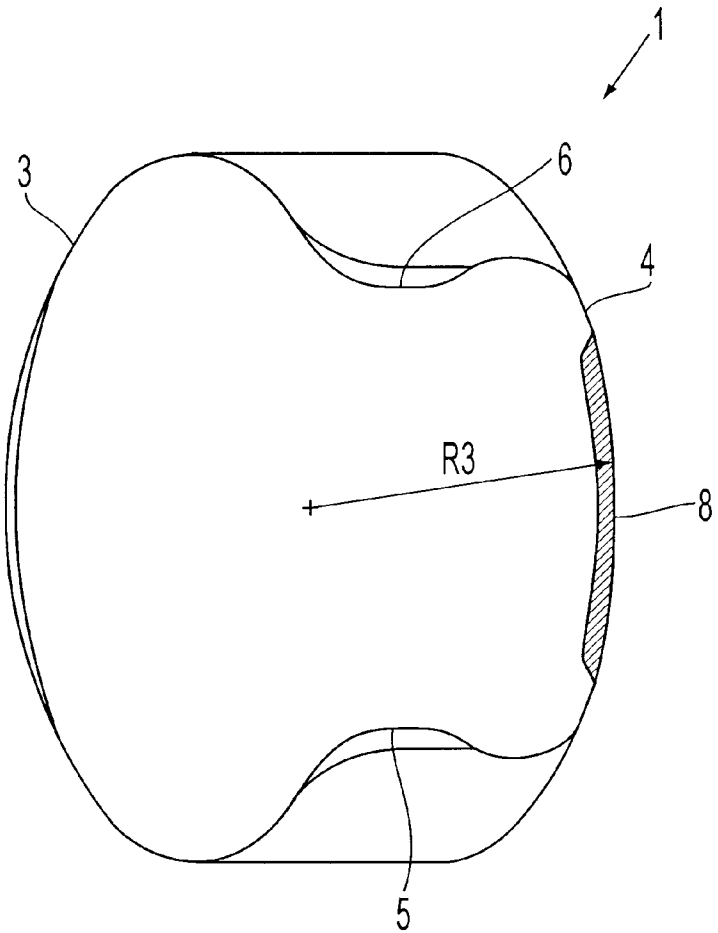
FIGS. 2*a* and 2*b* are schematic sectional views taken along the lines A—A and B—B in FIG. 1*a*, respectively.
Figure 2A:
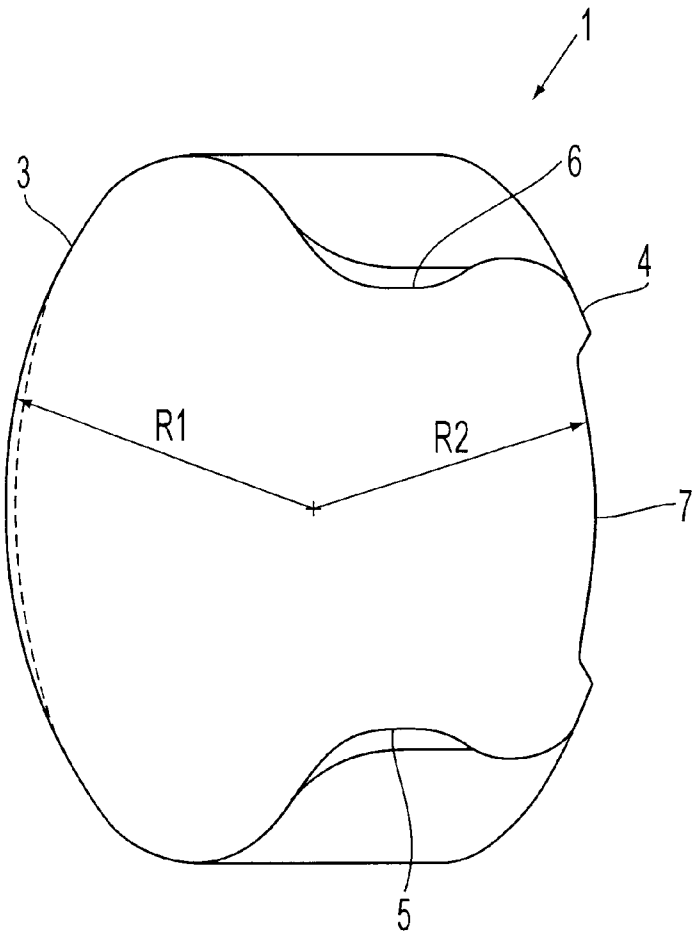

With reference to FIG. 2*a*, the front surface portion 3 of the body 2 has a radius of curvature R1 that is the basic radius of curvature of the body 2 itself. The radius of curvature R1 of the front surface portion 3 is smaller than the radius of curvature R2 of the rear surface portion 4. To be more specific, in the case of a container having an inner volume of 2,700 $cm^3$, tie radius of curvature R1 of the front surface portion 3 is within a range of 60–100 mm, preferably 80 mm, whereas the radius of curvature R2 of the rear surface portion 4 including the panel-like region 7 is approximately 1.5 to 2 times larger than the radius of curvature R1 of the front surface portion 3, preferably 120–160 mm. Due to the difference in the radius of curvature, the rear surface portion 4 of the body 2 is more liable to deform or deflect outwards, as compared to the front surface portion 3 forming the ornamental portion of the container 1, when the grip region is grasped by hand or when the liquid content is subjected to a change in temperature. The rear surface portion 4 of the body 2 so deformed comes into better conformity with consumer's palm and thereby achieves improved gripping fitness and stability. The enhanced deformation at the rear surface portion 4 of the body 2 also makes it possible effectively to suppress an excessive deformation of the ornamental front surface portion 3, thereby preventing the appearance of the container from undesirable degradation.

As further shown in FIG. 2*b*, the reinforcing rib 8 in the panel-like region 7 extending in the circumferential direction of the body 2 has a radius of curvature R3 that may be different from the radius of curvature R2 of the rear surface portion 4, so as to optimize the rigidity and/or strength of the rear surface portion 4. In many instance, the radius of curvature R3 of the reinforcing rib 8 is made slightly larger than the radius of curvature R2 of the rear surface portion 4.

The bottle-shaped plastic container 1 as explained above may be filled with a normal temperature liquid or a hot liquid at a temperature as high as 80–95° C., for example. For filling a hot liquid into the container, it is necessary to subject the neck portion of the container to a thermal crystallization, as know in the art. When a hot liquid is charged into the container and then cooled to a room temperature, the pressure within the container is reduced. Such a pressure drop is absorbed primarily by an inward deflection of the rear surface portion 4 of the body 2 including the panel-like region 7.

It will be appreciated that the present invention provides an improved plastic container that eliminates the problems of the prior art by suppressing the deformation of the body portion at the ornamental front surface portion when the grip region is rasped by hand, or the liquid content within the container is subjected to temperature change.

While the present invention has been described above with reference to a specific embodiment, various changes and/or modifications may be made without departing from the scope of the invention as defined by the appended claims.

What is claimed is:

1. A bottle shaped plastic container, comprising:

a body having a longitudinal direction and a circumferential direction;

an opening at a top of the container that allows liquid contents to be charged into the container and discharged therefrom;

a middle height region of the body, the middle height region comprising:

a non-flat front surface portion having a first radius of curvature, the first radius of curvature being substantially constant in the circumferential direction and substantially constant along the longitudinal direction, the front surface portion comprising substantially all of the middle height region that is viewable from a front of the bottle;

a non-flat rear surface portion having a second radius of curvature, the second radius of curvature being substantially constant in the circumferential direction and substantially constant along the longitudinal direction, the rear surface extending circumferentially outwards from a point substantially opposite a center point of the front surface portion;

a grip region, wherein sides of the middle height portion substantially adjacent to the rear surface portion are recessed inwards and juxtaposed to each other; and a reinforcement having a third substantially constant radius of curvature, the reinforcement located substantially in the center of the rear surface portion in the longitudinal direction of the body and that extends at least partially in the circumferential direction of the body;

wherein the third radius of curvature is larger than the second radius of curvature and the second radius of curvature is larger than the first radius of curvature.

2. The bottle-shaped plastic container according to claim 1, wherein the second radius of curvature is at least approximately 1.5 times larger than the first radius of curvature.

3. The bottle-shaped plastic container according to claim 1, wherein the container has an inner volume within a range of 1,800–4,000 $cm^3$.

4. The bottle-shaped plastic container according to claim 1, wherein the container is a hot fill container filled with a liquid content at a temperature of 80–95° C.

* * * * *